United States Patent [19]

Lonngren

[11] 3,991,940

[45] Nov. 16, 1976

[54] OXYGEN-FUEL GAS BURNER NOZZLE

[75] Inventor: Per-Lennart Lonngren, Oxie, Sweden

[73] Assignee: AGA Aktiebolag, Lidingo, Sweden

[22] Filed: Apr. 13, 1976

[21] Appl. No.: 676,404

[30] Foreign Application Priority Data

Apr. 14, 1975 Sweden ..... 7504251

[52] U.S. Cl. ..... 239/430; 239/433

[51] Int. Cl.[2] ..... F23D 13/26; B05B 7/04

[58] Field of Search ..... 239/427, 429–434.5, 239/417.5, 402, 403, 404, 405, 398, 567

[56] References Cited

UNITED STATES PATENTS

| | | | |
|---|---|---|---|
| 2,506,415 | 5/1950 | Geffroy | 239/430 X |
| 2,762,656 | 9/1956 | Fraser | 239/404 |
| 3,575,354 | 4/1971 | Hach | 239/430 X |

FOREIGN PATENTS OR APPLICATIONS

| | | | |
|---|---|---|---|
| 819,081 | 10/1951 | Germany | 239/427 |
| 53,737 | 1/1943 | Netherlands | 239/405 |
| 346,605 | 7/1972 | Sweden | 239/398 |
| 352,434 | 12/1972 | Sweden | 239/398 |
| 719,585 | 12/1954 | United Kingdom | 239/567 |
| 730,352 | 5/1955 | United Kingdom | 239/405 |
| 1,253,875 | 11/1971 | United Kingdom | 239/434 |

*Primary Examiner*—Robert S. Ward, Jr.
*Attorney, Agent, or Firm*—Larson, Taylor & Hinds

[57] ABSTRACT

In a burner nozzle for heating, flame cleaning, gas cutting, etc., where oxygen and fuel gas are mixed near the nozzle orifice, at least two expansion steps are provided for the oxygen, the last expansion step being connected by jet passages to nozzle discharge channels which intersect closed-ended fuel channels lying in the same imagined cylindrical or conical body, the intersections each occurring between the jet passage and the nozzle orifice of the discharge channel to form a relatively large mixing space determined by the depth and width of the channels and the angle between the channels. The closed-ended portion of each fuel channel beyond the intersection forms a resonator chamber for the gas. The nozzle provides good mixing and safety properties. The channels are formed as slots on the surface of an inner member, the slots being closed by an encompassing outer member.

7 Claims, 2 Drawing Figures

OXYGEN-FUEL GAS BURNER NOZZLE

FIELD OF THE INVENTION

The present invention relates to a burner nozzle for heating, flame cleaning, gas cutting and related processes, whereby the nozzle comprises channels for oxygen and fuel gas and whereby the gases are mixed near the orifice of the nozzle, the nozzle thereby comprising a centrally arranged cutting oxygen channel for cutting.

BACKGROUND AND SUMMARY

Until now existing oxygen burners, where the gases are mixed near the orifice of the nozzle, have above all two notable disadvantages; in the first place an incomplete mixing of the gases at the exit from the nozzle, secondly a mixing ratio too high for most heating processes. As examples can be mentioned the constructions described in the Swedish Patent Nos. 346,605 and 352,434, for which the mixing ratio between oxygen gas and acetylene gas varies between 2.5 and 3.0.

The purpose of the present invention is to overcome these disadvantages. The nozzle of the instant invention is characterized in principal in that at least two expansion steps for the oxygen gas are arranged along the center axis of the nozzle, the last expansion step, via jet members, being connected to the discharge channels of the nozzle, and that a chamber is arranged for the fuel gas, said chamber being connected to channels in the same imagined cylindrical or conical annular body as the discharge channels, wherein each fuel gas channel forms a defined angle with the corresponding discharge channel and cuts it at a place between the jet member and the orifice of the nozzle, whereby at the mixing place a large mixing space is obtained for the oxygen and the fuel gas, which space is determined by the depth and width of the channels and the angle between the channels, and wherein that part of the fuel gas channel, which is cut by the discharge channel, forms a resonator chamber for the gas.

A nozzle with good mixing and safety properties is obtained by this embodiment. Correct calculations and dimensioning of all the gas channels in the nozzle are a condition for obtaining these good properties, proceding from wanted capacity of the burner (gas consumption per unit of time), wanted mixing ratio or range for the same and wanted velocity of discharge for the gas mixture at the orifice of the nozzle. Furthermore, a suction effect on the fuel gas can be obtained in the "cross" by a suitable dimensioning of the oxygen jet members, the fuel gas channels and the discharge channels.

DESCRIPTION OF THE DRAWINGS

The nozzle will be further described in connection with the enclosed drawing, where.

DESCRIPTION OF PREFERRED EMBODIMENT(S)

Figure 1:
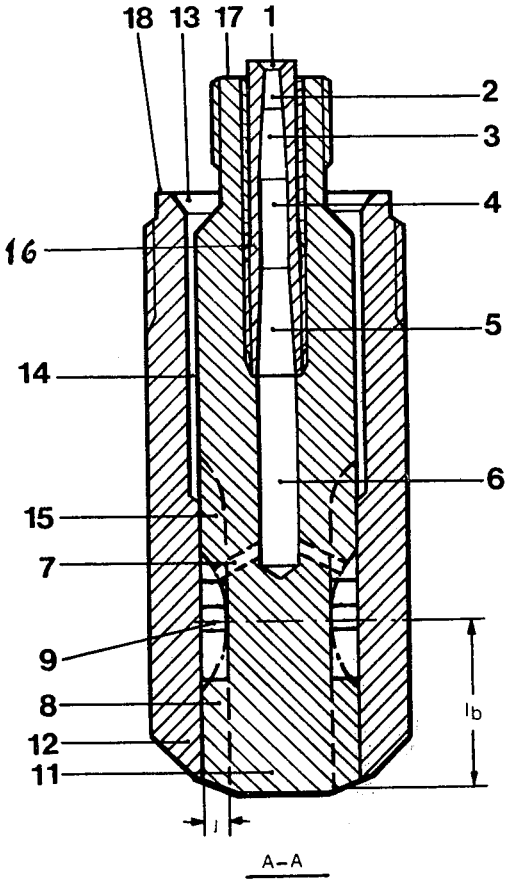
FIG. 1 shows a cross section in the longitudinal direction through an embodiment of the nozzle, and where
Figure 2:
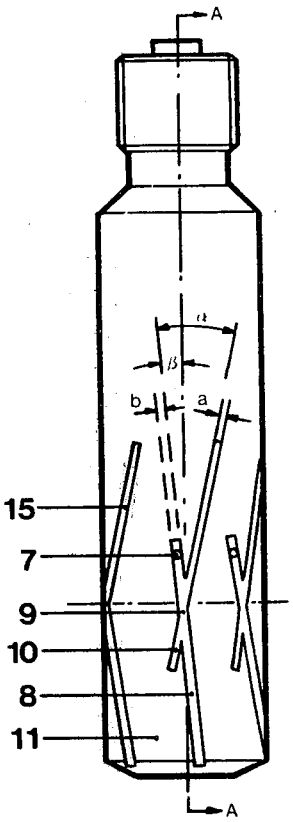
FIG. 2 shows the inner part of the nozzle.

As shown in the figures the nozzle comprises an inner part 11 and an outer part 12 enclosing the inner part. The inner part 11 can be a cylindrical or conical body and has a boring along the center axis, into which boring a sleeve 16 is entered. A feeding channel for oxygen is connected to the sleeve at denomination 1. In the sleeve a first expansion step is arranged, comprising a flow determining jet member 2 and a taper member 3, which together form a socalled laval nozzle. After the taper member 3 follows a first chamber 4 and a diffusor 5 connected to said chamber 4, said diffusor opening into a second chamber 6.

In the parts 2 and 3 the oxygen expands thereby being cooled down. This cooling can be done in several steps by introducing additional expansion jets, the cooling thereby being adjusted to keep the nozzle temperature well under the range of temperature where there is a risk of spontaneous self ignition of the oxygen fuel gas mixture, or if acetylene is used as fuel gas, where there is a risk that polyacetylenes may be developed. The cooling effect is obtained by a suitable choice of pressure drop and flow, based upon the heat being transmitted to the nozzle from the combustion of the gas mixture plus the heat that sometimes develops by the combustion of organic matter in front of the nozzle. Supercritical pressure ratio is prevalent at the jet. The high gas velocity is then reduced in the following diffusor 5, where the reduction of velocity is transformed into a pressure increase.

By jet members 7 the chamber 6 communicates with slots 8 on the cylindrical surface of the inner part 11, said slots or channels 8 extending to the orifice of the nozzle. A supercritical pressure ratio is prevalent also at the jet members 7 in order to obtain a certain cooling effect to reduce the risk of flash-back and to obtain a stable mixing ratio.

A cylindrical boring in the outer part 12 forms an annular chamber 14 around the inner part 11. The supply channel for the fuel gas is connected to the distribution chamber 14 at 13. In its lower part the chamber 14 communicates with fuel gas channels 15 on the cylindrical surface of the inner part 11. The channels 15 form a defined angle $\alpha$ with channels 8, which are discharge channels. The channels 8 are helically or pseudo-helically twisted and form an angle $\beta$ with the center axis of the nozzle in order to obtain a flame-stabilizing effect. However, the channels 8 may also be straight and parallel with the center axis of the nozzle. The fuel gas channels thereby cut the discharge channels thus forming a cross in which the gases are mixed.

At the mixing place the gases are effectively mixed over a large mixing surface $A_{b1}$, which is determined on the one hand by the depth $j$ of the channels, the depth preferably being the same for both channels, and on the other hand by the width of the channels (fuel gas channel width $a$ and discharge channel width $b$) as well as the angle $\alpha$ between them. The size of the mixing surface $A_{b1}$ will thereby be $$A_{bl} = j\sqrt{b^2 + [\frac{b}{tg\alpha} + \frac{a}{\sin\alpha}]^2}$$

As is evident from the above the mixing surface increases with increase of the channel depths and widths and with decrease of the angle $\alpha$. The channel width $b$ (the discharge channel) should be limited considering the risk that small, whitehot particles from the workpiece could be flung into the channels. The channel width $a$ of the fuel gas channel should also be limited to obstruct the propagation of an eventual acetylene deflagration. The cross, which is formed where the channels cut each other, also contributes to obstruct the propagation of an eventual pressure and combustion wave directly into the acetylene channel.

The surplus part 10 of the fuel gas channel forms a pocket, where the fuel gas channel 15 cuts the discharge channel 8, whereby the part 10 functions as a resonator chamber, in which the gases stand vibrating and thus to a great extent contributes to a good mixing of the gases.

If the nozzle is to be used for flame cleaning or heating a relatively high discharge velocity is desirable to obtain a good heat transfer and a good blow-off effect, and also to make the flame burn at a certain, even if small, distance from the nozzle orifice, thus contributing to keep the burning temperature as low as possible.

A practical example of a nozzle according to the invention is a flame cleaning burner for concrete having 24 nozzles dimensioned as follows:

| | | | |
|---|---|---|---|
| Number of nozzles | | = | 24 |
| Number or discharge and fuel gas channels respectively, per nozzle | | = | 6 |
| Width of fuel gas channel | a | = | 0.3 mm |
| Width of oxygen gas channel | b | = | 0.4 mm |
| Depth of channels | j | = | 1.2 mm |
| Angle between channels | $\alpha$ | = | 22° |
| Angle between nozzle-axis and discharge channel | $\beta$ | = | 7° |
| Distance from nozzle orifice to mixing place | $l_b$ | = | 10 mm |
| Fuel gas pressure | $p_a$ | = | 0.5 bar (overpressure) |
| Oxygen gas pressure | $p_o$ | = | 5 bar (overpressure) |
| Fuel gas flow | $V_a$ | = | 12 m³/h |
| Oxygen gas flow | $V_o$ | = | 20 m³/h |
| Mixing ratio | $\frac{V_o}{V_a}$ | = | 1.67 |
| Discharge velocity | $V_{bl}$ | = | 160 m/s |
| Nozzle distance, e.g. | | = | 35 mm |

As a sum-up, it can be stated that the good mixing and safety properties of the described nozzle depend on the fact that the mixing takes place in the cross, which is formed where the oxygen (discharge) channel and the acetylene channel cut each other, thus giving an effective mixture, even if the mixing distance is small, and allowing the space for the mixing ratio to be varied within wide limits by the choice of channel dimensions for oxygen, fuel gas and gaseous mixture independently of each other — however within the limits of the calculations. Another reason for the good properties is the effective cooling of the nozzle obtained by so-called expansion cooling, whereby an advanced expansion of the oxygen in one or more steps prior to the mixing with fuel gas is utilized. By means of the described nozzle, values of the pressure ratio at the expansion steps can be obtained, which are as low and, from the cooling point of view, as advantageous as 0.3 – 0.5. In earlier known nozzles provided with expansion cooling this ratio has not been below 0.528. Another factor which has an effect on the good properties of the nozzle is the use of a high discharge velocity to keep the flame burning at a small distance from the nozzle. Furthermore, the flame is stabilized by means of a certain helical or pseudohelical twist of the discharge channels.

The described nozzle is intended to be inserted into a burner body or a holder by means of threads, the sealing surface 17 on the inner part of the nozzle and the surface 18 on the outer part of the nozzle thereby bearing on the body or on the holder. Here a so-called flat surface sealing, preferably without packing, is used but it is also possible to use a so-called conical sealing. Consequently no inner sealing problems arise and furthermore, each nozzle can be individually exchanged in a simple manner.

The present nozzle is not limited to the embodiment now described but variations in different respects are possible within the scope of the invention.

I claim:

1. In a burner nozzle for heating, flame cleaning, gas cutting and related processes, having separate inlets for oxygen and fuel gas, a nozzle discharge orifice, and passages for conveying the oxygen and fuel from the inlets, mixing them near the discharge orifice, and passing the mixed gases to the discharge orifice, the improvement wherein the inlet passage from the oxygen inlet includes at least two expansion steps for the oxygen arranged along the central axis of the nozzle, and jet passages connecting the last expansion step to a plurality of discharge channels communicating with the nozzle discharge orifice, said discharge channels being disposed within and extending along an imagined surface of revolution about the central axis of the nozzle, a fuel gas chamber within the nozzle body connected to the fuel inlet, a plurality of closed-ended fuel channels disposed within and extending along said imagined surface of revolution, said fuel channels being connected at one end to said fuel chamber and being closed at the other end, each fuel channel forming a defined angle ($\alpha$) with and intersecting a corresponding discharge channel at a location along the corresponding discharge channel between its jet passage and the nozzle discharge orifice to form a mixing space for the oxygen and fuel, the space being determined by the depth and width of the discharge and fuel channels and the angle ($\alpha$) between them, the part of each fuel channel between its closed end and the intersection with its corresponding discharge channel forming a resonator chamber for the gas.

2. Burner nozzle in accordance with claim 1, characterized in that the discharge channels are arranged with a certain helical twist.

3. Burner nozzle in accordance with claim 2, characterized in that the angle ($\beta$) between the discharge channels and the central axis of the nozzle assumes values $6° < \beta < 10°$.

4. Burner nozzle in accordance with claim 1, characterized in that the angle ($\alpha$) between the channels assumes values $1° < \alpha < 90°$.

5. Burner nozzle in accordance with claim 1, characterized in that in the expansion for the oxygen gas in each expansion step, the outlet pressure ($p_x$) in the expansion step in relation to the inlet pressure ($p_o$) assumes values $$0.3 < \frac{p_x}{p_o} < 0.5.$$

6. Burner nozzle in accordance with claim 1 characterized in that the nozzle comprises an inner part, which along its central axis has said inlet passage connected to the inlet for oxygen, the inlet passage being connected to a first jet comprising a cylindrical jet member and an expansion member followed by a first chamber connected to a diffusor followed by a second chamber, the lower part of which by means of said jet passages is connected to slots on the surface of the inner part, said slots forming said discharge channels and extending to the nozzle orifice, said slots at a place between the orifices of said jet passages and the nozzle orifice being cut at a defined angle ($\alpha$) by other slots also made on the surface of the inner part and forming said fuel channels, whereby the slots form a cross where the gases mix; and an outer part enclosing the inner part whereby the slots form channels for the gases, the outer part having a cylindrical boring forming said fuel chamber as an annular chamber between the inner and the outer parts, the chamber being connected to the inlet for the fuel gas, and being connected at its lower end to said other slots which form said fuel channels.

7. Burner nozzle as claimed in claim 6 wherein the surface of said inner part on which said slots are formed is a surface of revolution by a straight line.

* * * * *